US006003412A

United States Patent [19]

Dlask et al.

[11] Patent Number: 6,003,412

[45] Date of Patent: Dec. 21, 1999

[54] BACK-UP TONG BODY

[75] Inventors: Jiri Dlask, Canmore; Darrall Rigby, Calgary, both of Canada

[73] Assignee: White Bear Energy Services Ltd., Calgary, Canada

[21] Appl. No.: 09/062,612

[22] Filed: Apr. 20, 1998

[51] Int. Cl.[6] ..... B25B 13/50

[52] U.S. Cl. ..... 81/57.34; 81/57.16

[58] Field of Search ..... 81/57.15–57.21, 81/57.33–57.35

[56] References Cited

U.S. PATENT DOCUMENTS

| | | | |
|---|---|---|---|
| Re. 31,699 | 10/1984 | Eckel | 73/862.25 |
| 3,799,010 | 3/1974 | Guier | 81/57.17 |
| 4,005,621 | 2/1977 | Turner, Jr. et al. | 81/57.2 |
| 4,402,239 | 9/1983 | Mooney | 81/57.16 |
| 5,062,326 | 11/1991 | Goldschmidt | 81/57.34 X |
| 5,546,833 | 8/1996 | Holdeman et al. | 81/57.34 X |
| 5,664,310 | 9/1997 | Penisson | 29/407.02 |

*Primary Examiner*—D. S. Meislin
*Attorney, Agent, or Firm*—Thomas E. Malyszko

[57] ABSTRACT

A back-up tong is provided for use with a power tong to make up and break out longitudinally adjoining pipe sections. A torque arm engages the back-up tong and power tong to transfer torque therebetween, and a load cell is provided to measure the torque. The rear of the back-up tong has a fin element is rotatably mounted thereto. The fin element and torque arm are driven together upon initiating make up or break out operations to trap the load cell therebetween. The rotatable fin element substantially maintains alignment with the load cell and torque arm during make up for more reliable torque measurements. The fin element may alternately be mounted to the power tong.

7 Claims, 2 Drawing Sheets

BACK-UP TONG BODY

FIELD OF THE INVENTION

The present invention relates to a back-up tong used for making and braking conventional threaded drill pipe connections in the oil and gas industry, and in particular to an improved back-up tong body for use with a load cell assembly.

BACKGROUND OF THE INVENTION

Tubular members such as drill pipe, tubing pipe and casing used in the oil and gas industry (herein referred to as "pipe sections") are joined at their ends by threaded connections. Power tongs and back-up tongs are used to make up (i.e. join) and break out (i.e. disconnect) these threaded connections. The back-up tong grips the lower stationary pipe section while the power tong grips the adjoining upper pipe section and rotates it to provide a fluid-tight seal during make up of the drill string, and to break out the threaded connection during disassembly of the drill string. Under-torquing a connection during make up may not provide the desired fluid-tight seal and adversely affect the integrity of the drill string, while over-torquing a connection may result in costly damages to the drill string, such as stripped threads on the pipe connection, and unnecessary operational delays. Hence, reliable torque readings during make up operations are increasingly important, particularly as equipment and manpower costs continue to rise.

The back-up tong is typically supported from and interconnected with the power tong by a support structure well known in the industry. Referring to the prior art assembly shown in FIG. 1, the frame structure normally includes a torque plate or leg 12 which extends downwardly from the power tong 10 and engages a rearwardly extending portion or heel 14 of the back-up tong 11. During make up operations the torque leg engages and bears against the back-up tong's heel to counteract the twisting forces of the power tong, although the torque leg is free to move vertically with the power tong relative to the back-up tong during make up and break out operations. A load cell or torque gauge 15 is located between the torque leg and back-up tong to measure the force therebetween to determine the torque applied by the power tong to the pipe connection between the upper and lower pipe sections 16, 17, respectively. The load cell may be fixed to the back-up tong's arm or to an adjacent surface of the torque leg.

A disadvantage of such prior art arrangements is that a rig operator does not obtain reliable torque measurements during make up operations. Forces exerted by the power tong on the frame structure can flex the torque leg so that it engages the load cell and/or the heel of the back-up tong at an angle rather than in a flat (i.e. parallel) manner, thus providing an uneven force distribution over the load cell and inaccurate torque readings. As a result the rig operator can not be sure whether the pipe connection is being under-torqued or over-torqued. Another problem is that such eccentric loadings on the load cell also lead to premature wear of the cell, which result in further inaccuracies and requires frequent replacement.

What is therefore desired is a novel back-up tong body which overcomes the limitations and disadvantages of the existing arrangements. Preferably, it should provide a means for enhancing the accuracy of torque measurements during make up of pipe connections, and in particular by improving alignment of the load cell with a torque plate or equivalent part of a tong's frame structure during make up operations.

It should also reduce wear on the load cell and associated servicing costs.

SUMMARY OF THE PRESENT INVENTION

In one aspect the invention provides a back-up tong apparatus for use with a power tong assembly to make up and break out longitudinally adjoining pipe sections, said power tong assembly including a torque arm for engaging said back-up tong apparatus and power tong assembly to transfer torque therebetween, said torque being measured by a load measurement device, said back-up tong apparatus comprising: a body portion having an open throat adapted to engage one of said pipe sections; and, a fin element rotatably mounted to said body portion, said fin element and torque arm being driven together upon initiating said make up to trap said load measurement device therebetween, said fin element substantially maintaining alignment with said load measurement device and torque arm during said make up.

In another aspect the invention provides an assembly for make up and break out of longitudinally adjoining pipe sections using a first tong apparatus, a second tong apparatus, and a support structure for transferring torque between said first tong apparatus and second tong apparatus, and a load reading element located between said support structure and said first tong apparatus for providing torque measurements, the improvement comprising a fin element having a contoured surface for flush engagement with a respective surface of said load reading element, said fin element being rotatably mounted to said first tong apparatus for substantially maintaining said flush engagement during said make up of the longitudinally adjoining pipe sections.

In yet another aspect the invention provides a device mountable to a back-up tong for transferring torque between the back-up tong, a load cell and a support means operatively engaged to a power tong during make up operations, said device comprising: a rear portion for engaging said load cell; and, a front portion extending from said rear portion for rotatably engaging a rear end of said back-up tong and for substantially maintaining said rear portion flush with said load cell and in alignment with said support means during said make up operations.

BRIEF DESCRIPTION OF THE DRAWING FIGURES

Embodiments of the invention will now be described, by way of example only, with reference to the accompanying drawings, wherein.

DESCRIPTION OF PREFERRED EMBODIMENT

Figure 1:
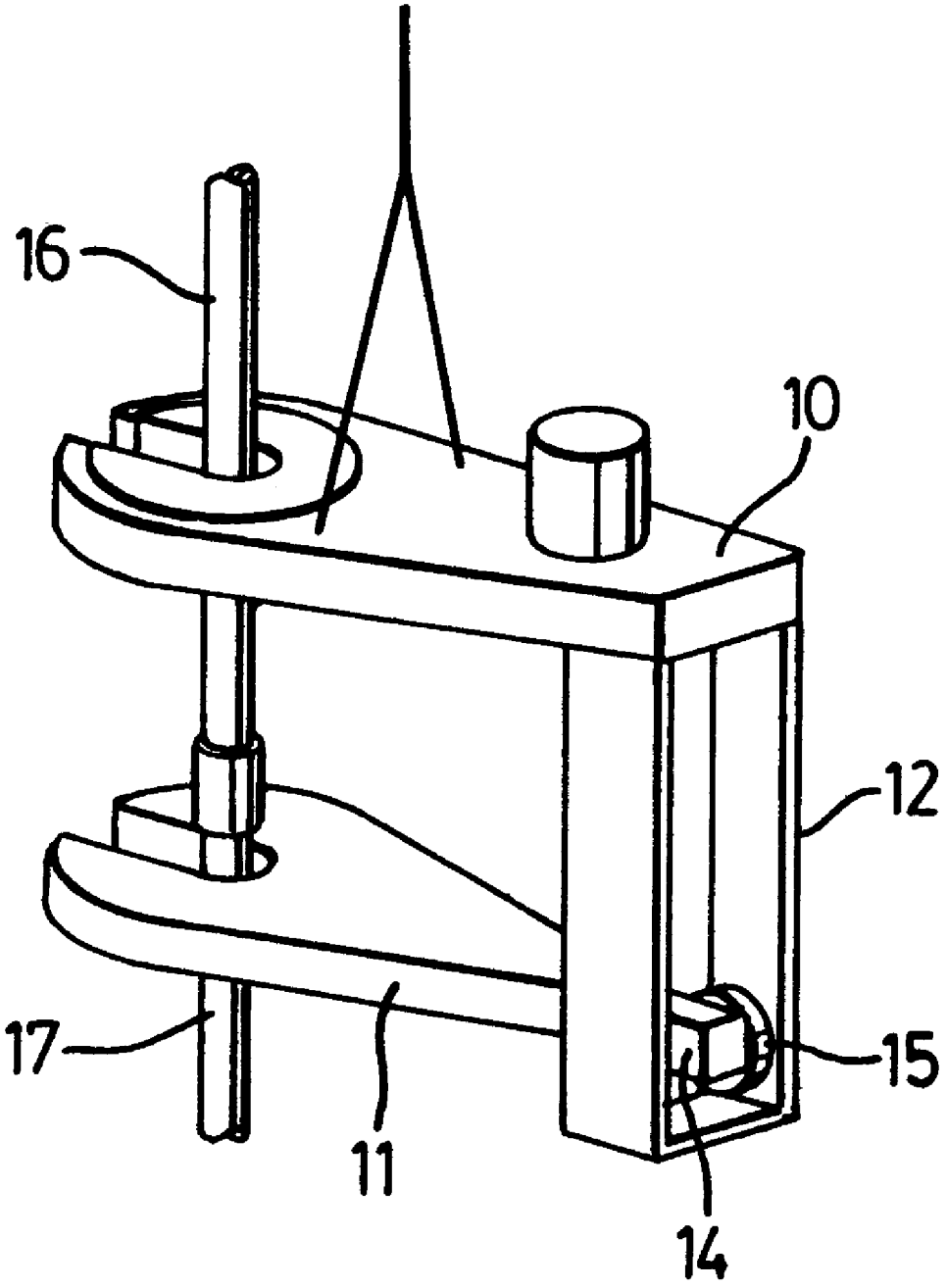
FIG. 1 (PRIOR ART)
FIG. 1 is a perspective view of a prior art power tong assembly.
Figure 4:
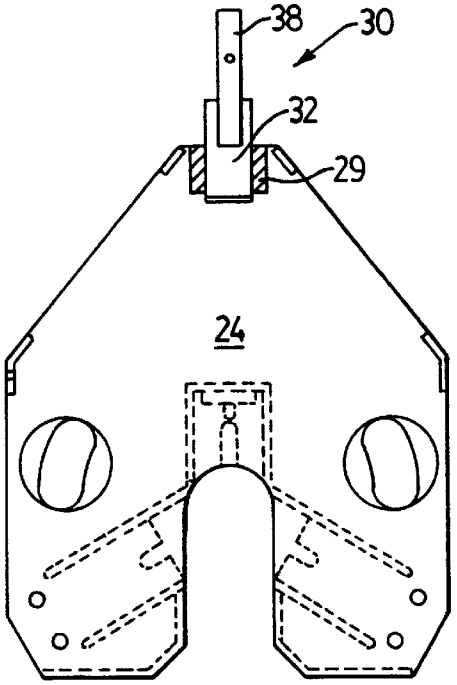
FIG. 4 is a view from below of the back-up tong of FIG.2.
Figure 3:
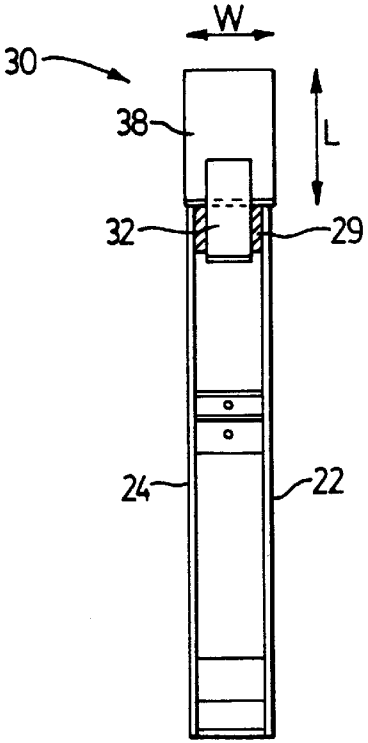
FIG. 3 is a side view of the back-up tong of FIG.2.
Figure 2:
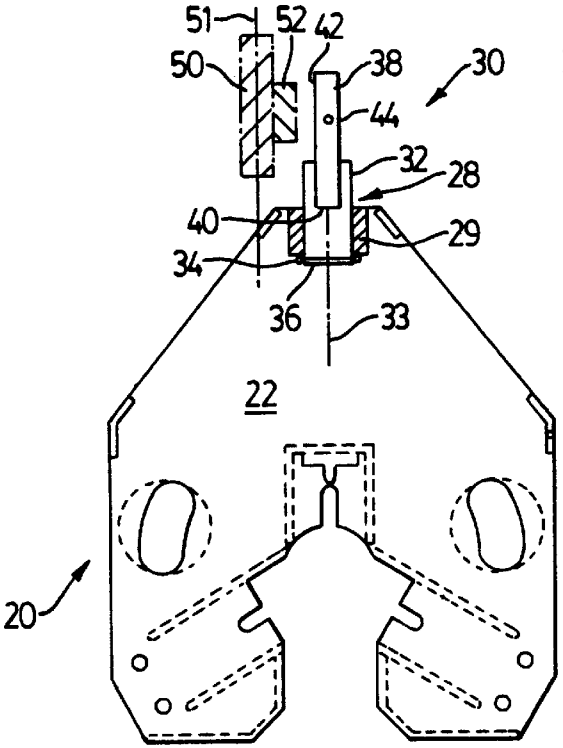
FIG. 2 is a plan view from above of a back-up tong body according to a preferred embodiment of the present invention.
Figure 5:
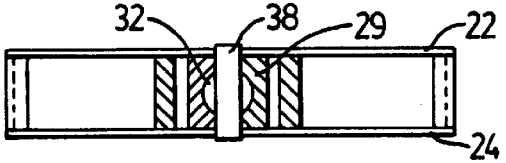
FIG. 5 is an end view from behind of the back-up tong of FIG.2.

FIGS. 2 to 5 show a back-up tong (generally designated by reference numeral 20) for use with a power tong (such as the one shown in FIG. 1, for example) in well drilling operations for making up and breaking out threaded connections between longitudinally adjoining pipe sections. The back-up tong 20 has a body or frame generally defined by upper and lower frame plates 22 and 24, respectively, connected by sidewalls and other frame elements. The front of the back-up tong has a throat or mouth 26 for receiving and securing a lower pipe section therein. The back-up tong 20 normally immobilizes the lower pipe section while a power tong positioned vertically above the back-up tong rotates an upper pipe section to either make up or break out the threaded connection therebetween. Hence, as the power tong threads or screws the connection, the power tong moves vertically downwardly towards the back-up tong during make up operations, and vertically upwardly away from the back-up tong during break out operations.

A support structure similar to the one previously described and illustrated in FIG. 1 has a torque plate or arm 50 (indicated in dotted outline in FIG.2) which extends downwardly from the power tong to engage a rearwardly extending portion or fin 30 of the back-up tong 20. According to the preferred embodiment of the present invention, the fin 30 has a first generally cylindrical portion or base 32 which sits in a correspondingly shaped opening 28 formed by a sleeve element 29 at the back of the back-up tong body. The fin's base 32 is free to rotate about its longitudinal axis 33 within the sleeve 29. The fin 30 is restrained from slipping out of the sleeve 29 rearwardly by a circular clip 34 (of larger diameter than the opening 28) which engages a circumferential groove 36 at the front end of the fin's base. The clip and groove arrangement also provides for quick and convenient removal of the fin from the back-up tong and reinsertion therein for servicing or replacement.

The fin's axial movement in the opposite (i.e. forward towards the throat 26) direction is prevented by a second portion or plate 38 integral with or otherwise fixed to the portion of the base 32 extending beyond the sleeve 29. A rear face 40 of the plate 38 is located adjacent the sleeve to minimize the axial play of the fin within the sleeve. The plate 38 has a first surface 42 contoutred for engaging a complimentary face of a load cell 52, which is fixed to the torque arm 50 in the embodiment shown. Preferrably the surface 42 is generally planar to match the generally planar face of a conventional load cell. The fin's opposed surface 44 may also be planar for engaging the load cell should the fin be rotated 180 degrees about its longitudinal axis. The size of the plate, namely the length "L" and width "W" of the rectangular plate of the preferred embodiment, should be sufficient so that the entire face of the load cell remains in contact with the fin as the torque arm slides vertically past the fin 30 during make up operations. The plate 38 should be thick enough to avoid excessive bending or deflection thereof during use. It will be appreciated that in an alternate embodiment the load cell 52 may be located on the fin's plate 38.

It can now be appreciated how the preferred embodiment of the present invention operates, and some of its many advantages. Upon activation of the power tong in a make up operation, the torque arm 50 and the fin plate 38 are driven together, with the load cell 52 being located and compressed between the torque arm and the fin plate's first surface 42. Upon such contact the fin's longitudinal axis 33 is typically generally parallel to the torque arm's major axis 52. As the power tong increases torque on the pipe connection, there is a comparable rise in the force exerted by the torque arm on the fin. Should the torque arm deflect out of plane (ie. bend about its major axis 52), the fin will also twist about its longitudinal axis 33 to remain in face-to-face or flush contact with the load cell 52. Hence, the rotatable fin 30 of the present invention improves alignment of the back-up tong with the load cell and torque arm over prior designs where the heel of the back-up tong is rigidly fixed thereto. Eccentric loadings to one side of the load cell are discouraged in the present invention by encouraging a generally even force distribution over the load cell, namely the resultant force vector between the fin and torque arm remains generally centered on the load cell, thus enhancing the accuracy of torque readings by the load cell over prior arrangements. Such rotational alignment between the torque arm, load cell and fin should also reduce wear on the load cell and discourage premature failure.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For instance, it will be appreciated that the fin 30 need not be limited to the rectangular shape shown in the drawings but may take other suitable forms (such as an oval shape), as long as the entire face of the load cell remains in contact with the fin or torque plate, as the case may be, throughout the entire range of vertical movement of the power tong relative to the back-up tong during make up operations. It will also be appreciated that the fin of the present invention may be adapted for mounting on the power tong should torque measurement be desired at that location and depending on the configuration of the support structure for the torque arm.

We claim:

1. A back-up tong apparatus for use with a power tong assembly to make up and break out longitudinally adjoining pipe sections, said power tong assembly having a torque arm extending therefrom for engaging said back-up tong apparatus and transferring torque therebetween, said torque being measured by a load measurement device operatively engaged with said torque arm, said back-up tong apparatus comprising:

a body portion having an open throat adapted to engage one of said pipe sections;

a fin element rotatably mounted to said body portion, said fin element having:

a planar portion for engaging said load measurement device upon initiating said make up; and a cylindrical portion extending from said planar portion and rotatably received within said body portion for substantially maintaining alignment of said planar portion with said load measurement device and torque arm during said make up; and, a sleeve member located in said body portion generally opposite said open throat for rotatably receiving said cylindrical portion of the fin element.

2. The back-up tong apparatus of claim 1 wherein said cylindrical portion includes means for restraining axial movement of the fin element out of the sleeve member comprising a circumferential groove for receiving a restraining clip.

3. In an assembly for make up and break out of longitudinally adjoining pipe sections including a first tong apparatus, a second tong apparatus, and a support structure operatively engaged to said second tong apparatus and extending to said first tong apparatus for transferring torque therebetween, said torque being measured by a load reading element operatively located between said support structure and said first tong apparatus, the improvement comprising:

a fin element having a contoured surface for flush engagement with a respective surface of said load reading element, said fin element being rotatably mounted to said first tong apparatus for substantially maintaining said flush engagement during said make up of the longitudinally adjoining pipe sections.

4. The assembly of claim 3 further including a sleeve means mounted to said first tong apparatus for rotatably receiving said fin element, said fin element including a first end for engaging said sleeve means and a second end extending away from said sleeve means for carrying said contoured surface.

5. The assembly of claim 4 wherein said second end of the fin element abuts said sleeve means for restraining axial movement of said fin element through said sleeve means in one direction, and said first end of the fin element has a clip means engaged thereto for restraining axial movement of said fin element in the opposite direction.

6. The assembly of claim 5 wherein said sleeve means is mounted to a rear portion of said first tong apparatus and said contoured surface is generally planar.

7. The assembly of claim 6 wherein said load reading element is fixed to one of said support structure and said contoured surface of the fin element.

* * * * *